US005499934A

United States Patent [19]

Jacobsen et al.

[11] Patent Number: 5,499,934

[45] Date of Patent: Mar. 19, 1996

[54] HEXAGONAL CRIMP CONNECTOR

[75] Inventors: Ingolf G. Jacobsen; Arvin L. Langham, both of Phoenix, Ariz.

[73] Assignee: Cabel-Con, Inc., Phoenix, Ariz.

[21] Appl. No.: 271,840

[22] Filed: Jul. 7, 1994

Related U.S. Application Data

[63] Continuation of Ser. No. 68,435, May 27, 1993, Pat. No. 5,338,225.

[51] Int. Cl.[6] ..... H01R 4/24

[52] U.S. Cl. ..... 439/585; 439/877

[58] Field of Search ..... 439/578–585, 439/675, 877–883

[56] References Cited

U.S. PATENT DOCUMENTS

| | | | |
|---|---|---|---|
| 3,355,698 | 11/1967 | Keller | 339/97 |
| 3,363,222 | 1/1968 | Karol | 339/221 |
| 3,845,454 | 10/1974 | Hayward et al. | 339/85 |
| 3,847,463 | 11/1974 | Hayward et al. | 339/8 P |
| 4,047,788 | 9/1977 | Ferney, Jr. et al. | 339/177 |
| 4,145,729 | 3/1979 | Hayward | 361/119 |
| 4,345,375 | 8/1982 | Hayward | 30/90.1 |
| 4,355,857 | 10/1982 | Hayward | 339/177 R |
| 4,400,050 | 7/1983 | Hayward | 339/177 |
| 4,553,806 | 11/1985 | Forney, et al. | 339/94 C |
| 4,575,274 | 3/1986 | Hayward | 403/2 |
| 4,668,043 | 5/1987 | Saba et al. | 339/177 R |
| 4,681,390 | 7/1987 | Hayward | 439/587 |
| 4,684,201 | 8/1987 | Hutter | 439/585 |
| 4,755,152 | 7/1988 | Elliot et al. | 439/452 |
| 4,797,121 | 1/1989 | Hayward | 439/579 |
| 4,806,116 | 2/1989 | Ackerman | 439/304 |
| 4,925,403 | 5/1990 | Zorzy | 439/578 |
| 4,990,106 | 2/1991 | Szegda | 439/585 |
| 5,055,060 | 10/1991 | Down et al. | 439/304 |
| 5,073,129 | 12/1991 | Szegda | 439/585 |
| 5,083,943 | 1/1992 | Tarrant | 439/583 |
| 5,141,451 | 8/1992 | Down | 439/585 |
| 5,217,393 | 6/1993 | Del Negro et al. | 439/585 |

FOREIGN PATENT DOCUMENTS 2406417 8/1974 Germany .

OTHER PUBLICATIONS

Smith, Barry. "Don't drop the ball on the drop". Apr. 1991. *Communications Technology.* pp. 86–99.

*Primary Examiner*—David L. Pirlot
*Attorney, Agent, or Firm*—Cahill, Sutton & Thomas

[57] ABSTRACT

A crimp connector for attachment to a coaxial cable by use of a conventional crimping tool includes a plurality of annular ridges to be crimped, which ridges define a modified hexagonal perimeter having three pairs of opposed planar surfaces and curved surfaces interconnecting adjacent ones of the planar surfaces. A method for crimping resulting in migration of the material of the ridges to maintain a rounded surface about the coaxial cable is disclosed.

24 Claims, 2 Drawing Sheets

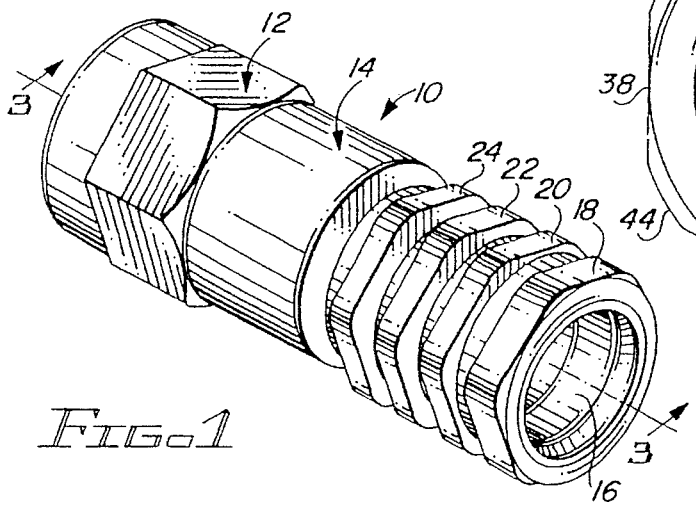
FIG. 1
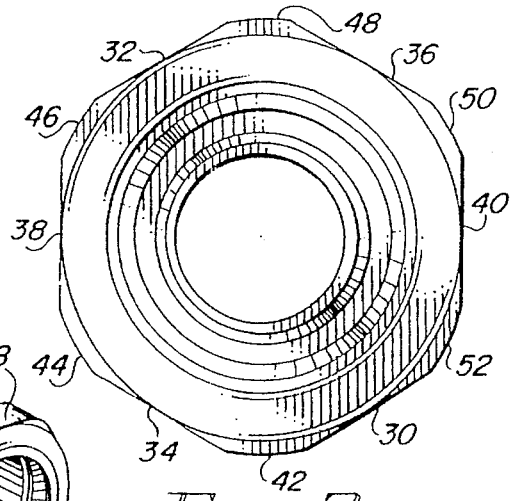
FIG. 2
FIG. 3
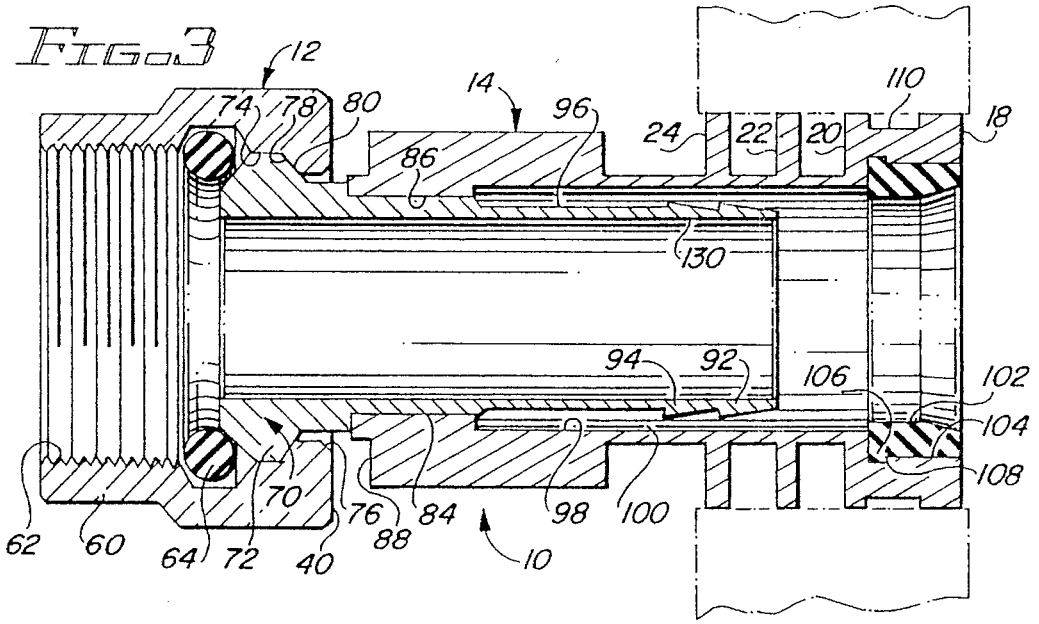
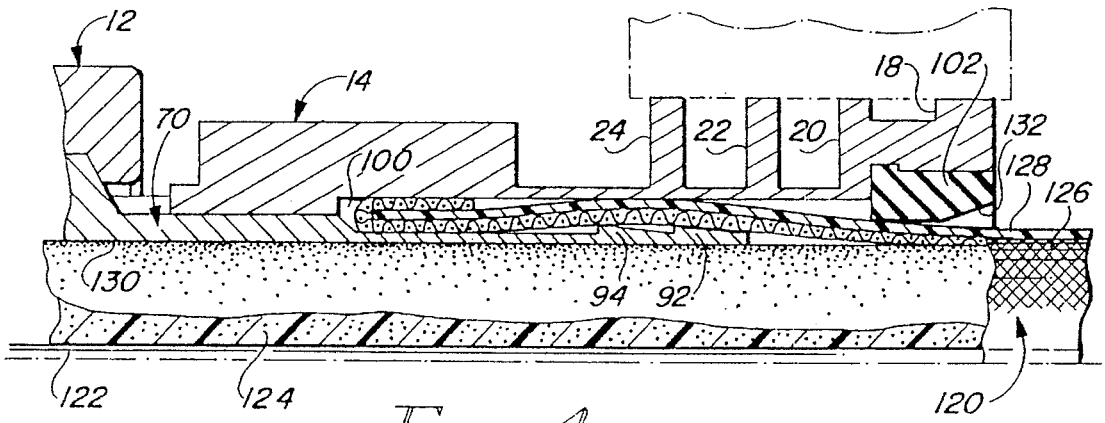
FIG. 4

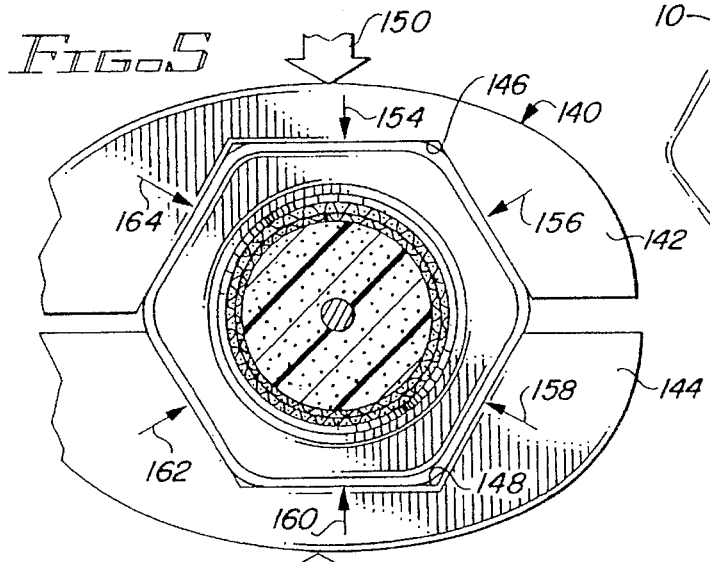
FIG. 5
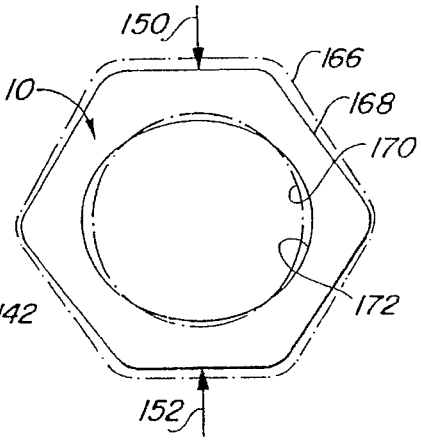
FIG. 6
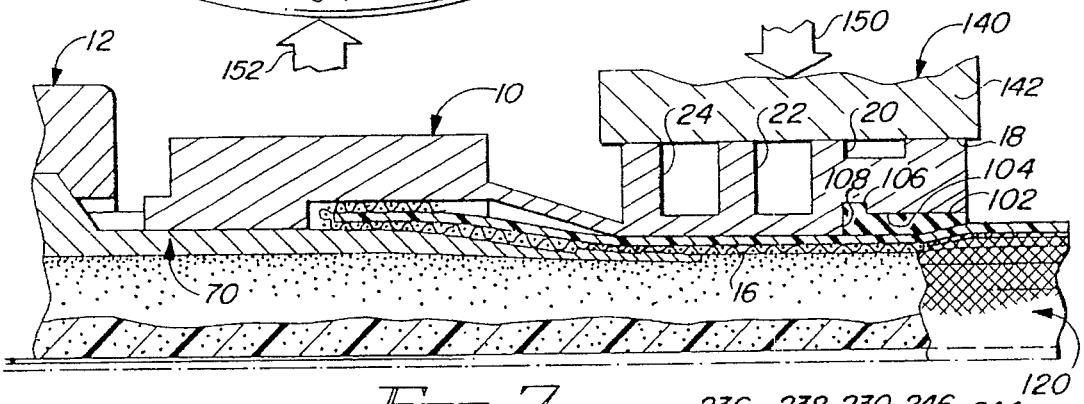
FIG. 7
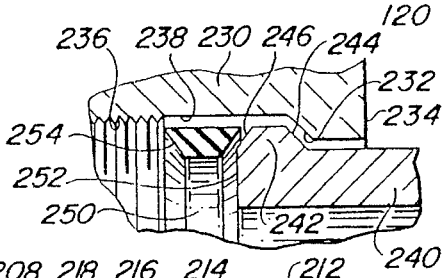
FIG. 9
FIG. 8
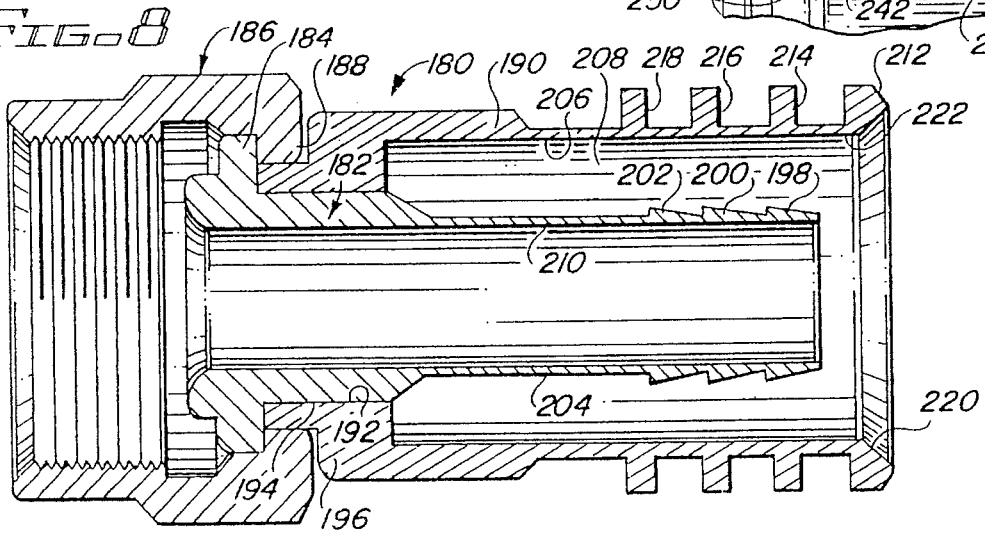

HEXAGONAL CRIMP CONNECTOR

This is a continuation application Ser. No. 08/068,435 filed May 27, 1993 U.S. Pat. No. 5,338,225.

BACKGROUND OF THE INVENTION

1. Field of the Invention

The present invention relates to coaxial cable connectors and, more particularly, to hexagonally crimped coaxial connectors.

2. Description of Related Art

Coaxial cable connectors are commonly used as terminal ends for coaxial cables of the type used to transmit television broadcast signals by land line. These cables may also be used to transmit other electric signals between various types of electronic devises.

Coaxial cables of this type include a central conductor for transmitting the signal and an encircling sleeve of dielectric material. A braided sheath, encircling the dielectric material, is encased within a jacket of neoprene or the like. The primary functions of a coaxial cable connector include making a solid mechanical engagement between the coaxial cable and the connector, making a good electrical connection between the braided sheath of the coaxial cable and the connector and preventing incursion of moisture and other foreign matter between the connector and the coaxial cable.

The coaxial connectors used during installation and attachment of a coaxial cable are mounted upon the terminal end of the cable. After mounting, the procedures of which may differ depending upon the configuration of the parts of the connector, an annular crimping force is applied with a tool to cause a segment of the connector to be annularly radially crimped to establish a compression fit with the jacket and underlying braided sheath of the coaxial cable. Connectors having a cylindrical skirt which is hexagonally crimped about the terminal end of the cable are standard in the industry. Because the hexagonal crimp may not be circumferentially uniform, voids exist adjacent the jacket, which voids permit intrusion of moisture and foreign matter. Moreover, the degree to which the cable terminal end has been properly dressed is a factor in determining the quality of the mechanical and electrical engagement achieved. Sometimes a cable or a connector may be off size which often results in a degraded connection.

SUMMARY OF THE INVENTION

A connector for a coaxial cable is mounted onto the terminal end of the cable after the cable has been dressed. A body of the connector, rotatably supporting a nut, includes a passage way for receiving the conductor and the surrounding dielectric sleeve to permit insertion of the free end of the body intermediate the dielectric sleeve and the braided sheath. A ferrule, friction fitted upon the body, annularly envelopes the terminal end of the cable. The ferrule includes a cylindrical surface adjacent the jacket of the cable and one or more radially extending annular ridges defining a generally hexagonal perimeter having arcuate segments interconnecting adjacent flats. Upon application of a crimping force to the annular ridges by the crimping tool, radially oriented pressures will be applied to the annular ridges to crimp the ferrule and migration of the material of the annular ridges to the corners of the crimping tool will occur. The migration, in combination with the original hexagonal configuration of the annular ridges, results in transmission of forces sufficient to prevent the interior cylindrical surface of the ferrule from becoming hexagonal shaped as a result of the applied crimping forces. The maintenance of an essentially interior rounded surface about the jacket of the coaxial cable will preclude voids between the cable and the ferrule and will provide a weather tight seal, which seal may be augmented by a bushing.

It is therefore a primary object of the present invention to provide an encircling sealed engagement between a hexagonally crimped connector and an attached coaxial cable.

Another object of the present invention is to provide a connector accommodating migration of the material of annular ridges hex crimped about a coaxial cable to establish a weather tight seal with an encircled coaxial cable.

Still another object of the present invention is to provide a connector for a coaxial cable having annular ridges defining a modified hexagonal perimeter to be hexagonally crimped by a conventional crimp tool.

Yet another object of the present invention is to provide a coaxial cable connector having annular ridges with arcuate segments interconnecting adjacent flats prior to crimping.

A further object of the present invention is to provide a hexagonally crimped connector for uniformly circumferentially gripping an encircled coaxial cable.

A yet further object of the present invention is to provide a hexagonally crimped connector for sealingly circumferentially gripping the jacket of an encircled coaxial cable.

A still further object of the present invention is to provide a method for attaching a connector to the terminal end of a coaxial cable.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 1 is a perspective view of a coaxial cable connector;

FIG. 2 is an end view of the connector;

FIG. 3 is a cross sectional view taken along lines 3—3, as shown in FIG. 1;

FIG. 4 is a partial cross sectional view illustrating a coaxial cable inserted within the connector prior to crimping;

FIG. 5 illustrates application of a hex crimp to the connector;

FIG. 6 illustrates deformation of the annular ridges of the connector after crimping;

FIG. 7 illustrates crimping of the connector and the resulting engagement of the connector with the coaxial cable;

FIG. 8 illustrates a variant of the connector shown in FIG. 3; and FIG. 9 illustrates a variant seal for the connector.

DESCRIPTION OF THE PREFERRED EMBODIMENT

The terminal ends of coaxial cables used to transmit signals to receiving television sets from related signal generating or signal transmitting equipment are terminated by hexagonally crimped connectors. Such connectors generally include a ferrule circular in configuration and may include one or more circular annular ridges. Upon crimping of such a connector with a conventional hexagonal crimp tool, the circular cross section of the connector is transformed into an essentially hexagonal cross section. The flats of such hexagonal configuration serve in the manner of three opposed pairs of gripping elements for retaining the coaxial cable attached to the connector. Various modifications to enhance the gripping strength upon transformation of the ferrule from a circular cross section to a hexagonal cross section have been developed over the years.

Referring to FIG. 1, there is illustrated a cable connector 10 for terminating a coaxial cable and for attaching such terminal end to a piece of electric or electronic equipment, such as a television set. The connector includes a nut 12 for attaching the connector to the piece of equipment. A ferrule 14 is rotatably attached to the nut for receiving and gripping the terminal end of a coaxial cable. The ferrule includes a generally cylindrical interior 16 and one or more annular ridges 18, 20, 22 and 24. As particularly shown in FIG. 2, ridge 18, as well as ridges 20, 22 and 24, includes a plurality of opposed pairs of flat or planar surfaces 30 and 32, 34 and 36, 38 and 40. A plurality of curved surfaces 42, 44, 46, 48, 50 and 52 interconnect adjacent ones of the planar surfaces. In the preferred embodiment, each curved surface defines an arc having a radius equivalent to half of the distance between opposed curved surfaces.

Further details attendant connector 10 will be described with joint reference to FIGS. 1, 2 and 3. Nut 12 may include a skirt 60 having internal threads 62 for threaded engagement with the piece of equipment to which connector 10 and a coaxial cable extending therefrom is to be attached. Sealing means, such as O-ring 64 may be incorporated within nut 12 to form a weather tight seal between the nut and the piece of equipment to which it is to be attached. A body 70 includes an annular shoulder 72 matingly engaged with annular depression 74 formed within nut 12. Lip 76 of the nut extends radially interiorly of shoulder 72 to capture the shoulder. Opposed inclined surfaces 78 of lip 76 and 80 of shoulder 72 mate with one another and form a seal therebetween during tightening of nut 14 with the piece of equipment.

Body 70 includes an annular surface 84 force fitted within annular surface 86 of ferrule 14 to mechanically retain the body joined with the ferrule. End wall 88 of body 70 is displaced from end wall 90 of lip 76 to permit rotation of nut independently of commensurate rotation of either body 70 or ferrule 14. As wall 88 of ferrule 14 and shoulder 72 of body 70 capture lip 76 of nut 12 therebetween, the nut is retained captured.

Body 70 includes a pair of annular barbs 92 and 94. Typically, barb 94 may define a cone angle of 10 degrees while barb 94 may define a cone angle of 4 degrees. Alternatively, the cone angles of both barbs may be the same, such as 8 degrees. An annular depression 96 about body 70, in combination with an annular cavity 98 within ferrule 14 define a cylindrical slot 100 for receiving the folded over braided sheath and jacket of a cable to be terminated by conductor 10, as illustrated in FIG.

The terminal end of ferrule 14 may include a bushing 102 for sealingly encircling the jacket of a coaxial cable inserted therethrough. An annular cavity 104 may be formed within the ferrule to receive and retain the bushing in place. Such retention may be enhanced by incorporating a rib 106 of the bushing extending into a commensurately configured annular key way 108. To accommodate annular cavity 104, a circular land 110 encircles the cavity intermediate ridges 20 and 18.

As particularly illustrated in FIG. 4, a coaxial cable 120 to be terminated by connector 10, includes a conductor 122 encapsulated within a sleeve 124 of dielectric material. A braided sheath 126 encircles the sleeve. A jacket 128, which may be of neoprene or similar material, forms the covering of the coaxial cable. Conductor 122 and sleeve 124 are penetrably inserted through cylinder 130 of body 70. The conductor extends into skirt 60 of nut 14 for electrical connection with an element of the piece of equipment to which the nut is attached. The sleeve is generally terminated prior to entry into skirt 60. The end of body 70 containing barbs 92 and 94 is forced between braided sheath 126 and sleeve 124. As particularly illustrated in FIG. 4, the braided sheath may be folded back over the end of jacket 126 during dressing of the terminal end of coaxial cable 120. The braided sheath, in combination with the jacket are lodged within slot 100. Bushing 102 encircles the jacket of the coaxial cable. As illustrated, the bushing may include a cone shaped ramp 132 to guide the braided sheath and jacket into the ferrule.

FIG. 5 illustrates a conventional crimping tool 140, which tool is widely used in the industry to hexagonally crimp connectors and thereby mechanically and electrically mate the connector with the terminal and of an inserted coaxial cable. The tool includes a jaw 142 pivotally mating with a further jaw 144. Half of a hexagonal indentation 146 is formed in jaw 142 and a mirror image indentation 148 is formed in jaw 144. The two jaws are attached to handles pivotally connected to one another in the manner of a pair of pliers. When such a tool is used with conventional coaxial cable connectors, the rounded ferrule of the connector is transformed into a hexagonal crosssectional shape. To accommodate the reduced crosssectional area of the hex crimped ferrule, the flats formed tend to be radially inwardly bowed. The hexagonal crosssectional area of the ferrule does not conform with the circular cross section of the crimped coaxial cable. The resulting nonconformance produces voids or channels through which moisture and foreign matter may seep into or enter the connector. The internal bowing of the flats of the ferrule contribute to the nonconformance and the creation of accompanying voids.

Connector 10 described herein includes at least one annular ridge (18) disposed about ferrule 14, which ridge has a hexagonal like perimeter (defining a hexagonal like planform in cross section). As particularly illustrated in FIG. 2, curved surfaces 40, 42, 44, 46, 48 and 50, interconnecting adjacent planar surfaces, are rounded and not sharp cornered. Upon engagement of jaws 142, 144 about one or more of ridges 18, 20, 22 and 24, voids will exist between the corners of depressions 146, 148 and the corresponding curved surfaces of the annular ridges. Furthermore, the diametric distance between any paired opposed curved surfaces of the ridges is slightly less than the distance at the widest point or opening of either of indentations 146, 148.

Upon closure of jaws 142, 144 of tool 140 about at least one of ridges 18, 20, 22 and 24 of connector 10 after cable 120 has been inserted therein, the jaws are squeezed, as represented by arrows 150, 152. The compressive or crimping forces induced by tool 140 upon each of the planar surfaces of the engaged ridge(s) are represented by arrows 154, 156, 158, 160, 162 and 164. As particularly illustrated in FIG. 6 in combination with FIG. 5, the opposed halves of the ridge(s) will be squeezed toward one another and the affected ridge half(yes) will be flattened in a plane normal to opposing forces 150, 152. This change in configuration from the outline or planform 166 to planform 168 is depicted by dashed lines in FIG. 6. Similarly, the internal cylindrical surface of the affected ridge(s) will be altered from a circular shape 170 to a somewhat oval or ellipsoidal shape 172. Simultaneously with the changing planform of the affected ridge(s), compressive forces 154, 156, 158, 160, 162 and 164 will cause migration of the material of the affected ridge(s) into the voids present between curved surfaces 42, 44, 46, 48, 50 and 52 and the corresponding corner intersections between the planar surfaces of depressions 146, 148 of jaws 142, 144. Such migration will alleviate the strains and stresses imposed upon the affected ridge(s) and prevent more than a slight change in curvature of the internal cylindrical surface(s) of the ferrule corresponding with the affected ridge(s). Accordingly, the resulting crimping of the internal cylindrical surfaces of the affected ridges will essentially uniformly and circumferentially grip the encircled jacket of coaxial cable 120.

Referring to FIG. 7, there is illustrated in partial cross section jaw 142 of tool 140 acting upon and crimping all of ridges 18, 20, 22 and 24 in response to force 150. The resulting reduced diameter of internal surface 16 will circumferentially compress coaxial cable 120 therewithin. To enhance the weather tight seal between connector 10 and coaxial cable 120, annular bushing 102 is also compressed intermediate the coaxial cable and depression 104 supporting the bushing.

Test results indicate that the mechanical grip provided by the above described method for crimping connector 10 will withstand a tension force imposed upon the cable of at least 60 pounds. Upon application of a greater force, the coaxial cable fails and not the gripping capability of connector 10. Conventional coaxial cable connectors are generally not capable of withstanding a tension force of greater than 40 pounds before failure of the gripping capability occurs.

FIG. 8 illustrates a variant 180 of connector 10. In this variant, body 182 includes an annular shoulder 184. Nut 186 includes a lip 188 extending radially inwardly of the perimeter of shoulder 184 to provide a mechanical locking engagement therebetween to draw body 182 toward a piece of equipment to which the nut may be threadedly attached. Ferrule 190 includes an internal cylindrical surface 192 force fitted upon cylindrical surface 194 of body 182. A shoulder 196 of ferrule 190 captures lip 188 of nut 186 between it and annular shoulder 184. Body 182 extends close to the open end of ferrule 190 and may include three annular barbs 198, 200, and 202. Cylindrical surface 204 of body 182 in combination with annular depression 206 of ferrule 190 define an annular cavity 208 for receiving the braided sheath and the jacket of the coaxial cable (as illustrated in FIG. 4). Internal passageway 210 of body 182 accommodates passage therethrough of the sleeve and conductor of the coaxial cabre. A plurality of annular ridges 212, 214, 216 and 218, having a modified hexagonal plan form (as illustrated in FIG. 2) extend radially from ferrule 190. One or more of these ridges may be acted upon by tool 140 during crimping of variant 180 about an inserted coaxial cable. A cone shaped ramp 220 may be disposed at opening 222 of the ferrule to guide the coaxial cable into variant 180.

The operation of variant 180 is the same as that described above with respect to connector 10. Similarly, the resulting configuration of the variant after crimping will be the same as that described above. Although not illustrated, an o-ring may be disposed within nut 186, as shown with respect to connector 10 in FIG. 3 to provide a sealing function with the piece of equipment to which the variant is attached.

Referring to FIG. 9, there is shown an alternate embodiment for sealing a nut 230 of a connector, such as connector 10 or variant 180. The nut includes a cone shaped annular surface 232 formed as part of radially inwardly extending lip 234. Threads 236 in the nut are used to threadedly engage a piece of equipment to which the nut is to attached. An internal cylindrical surface 238 interconnects threads 236 with cone shaped surface 232. Body 240 of the connector includes a shoulder 242 having a cone shaped surface 244 for mating with and sealingly engaging cone shaped surface 232. A further cone shaped surface 246 is disposed on the other side of shoulder 242. A wedge shaped seal 250 is supported generally adjacent cylindrical surface 238 of nut 230. This seal, which may be trapezoid shaped in cross section as illustrated, includes a cone shaped surface 252 for sealing engagement with cone shaped surface 246 of body 240. A further cone shaped surface 254 of the seal engages and sealingly mates with an annular section of a threaded stud of the piece of equipment to which nut 230 may be attached.

In operation, upon threaded engagement of nut 230 with a threaded stud extending from the piece of equipment, seal 250 will engage the stud. Upon such engagement, the seal will contact cone shaped surface 246 of body 240 and urge the body out of the nut. Upon such urging, cone shaped surface 244 of the body will contact cone shaped surface 232 of the nut to form a mating seal therebetween. On further tightening of the nut, compressive forces urge seal 250 into sealed engagement with cylindrical surface 238 of the nut and with cone shaped surface 246 of the body. The resulting seal, in combination with the further seal provided by contact of lip 234 with shoulder 246 will preclude entry of moisture or other foreign matter.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

We claim:

1. A connector for crimped attachment to a coaxial cable having a central conductor disposed within a dielectric sleeve, a braided sheath surrounding the sleeve and a jacket encircling the braided sheath, said connector comprising in combination:

a) an hollow body for penetrable insertion intermediate the sleeve and the braided sheath to locate the conductor and sleeve within said body;

b) a ferrule attached to and extending from said body for enveloping the coaxial cable;

c) said body and said ferrule defining in combination a cylindrical slot for receiving the braided sheath and the jacket; and d) at least one annular ridge encircling said ferrule, at least one of said ridges having a modified hexagonal perimeter defining three pairs of opposed planar surfaces and curved surfaces interconnecting adjacent ones of said planar surfaces prior to crimped attachment of said connector to the coaxial cable.

2. The connector as set forth in claim 1 wherein each of said curved surfaces defines a segment of a cylindrical surface.

3. The connector as set forth in claim 1 wherein said ferrule includes a first end for attachment to said body and a second end supporting at least one of said ridges for encircling the coaxial cable, said second end including a bushing for sealingly engaging the perimeter of the coaxial cable to establish a seal therebetween.

4. The connector as set forth in claim 3 wherein said bushing is of plastic material.

5. The connector as set forth in claim 1 wherein said ferrule is of annealed brass to accommodate migration of the material of each one of said ridges upon crimping of said connector with a crimping tool.

6. The connector as set forth in claim 1 wherein said ferrule includes a first end for attachment to said body and a second end supporting at least one of said ridges, said second end extending axially past said body for encircling the coaxial cable.

7. The connector as set forth in claim 6 including a bushing disposed in said second end for encircling and sealingly engaging the coaxial cable.

8. The connector as set forth in claim 1 including means for attaching said connector to a piece of electrical equipment.

9. The connector as set forth in claim 8 including seal means disposed within and retained by said attaching means for providing a weather seal between said connector end the piece of equipment.

10. The connector as set forth in claim 9 wherein said seal means is an O-ring.

11. The connector as set forth in claim 9 wherein said seal means is an annular wedge seal.

12. The connector as set forth in claim 11 wherein said wedge seal is trapezoid in cross-section.

13. The connector as set forth in claim 1 wherein said ferrule includes a first end for attachment to said body and a second end and including at least two of said ridges disposed adjacent said second end and a land disposed intermediate said two ridges.

14. The connector as set forth in claim 13 including an interior annular depression disposed in said second end proximate said land and a bushing disposed in said depression for encircling the coaxial cable to provide a seal therebetween.

15. A method for attaching a connector to the terminal end of a coaxial cable having a central conductor disposed within a dielectric sleeve, a braided sheath surrounding the sleeve and a jacket encircling the braided sheath, said method comprising the steps of:

a) inserting an hollow body of the connector intermediate the sleeve and the braided sheath to locate the conductor and the sleeve within the body and to position the coaxial cable within an hollow circular interior of a ferrule attached to and extending from the body;

b) further inserting the braided sheath and the jacket within a cylindrical slot formed by the body and the ferrule;

c) compressing between opposed jaws of a crimp tool defining a hexagon at least one ridge encircling the ferrule having a modified hexagonal perimeter defining three pairs of a parallel planar surfaces and curved surfaces interconnecting adjacent ones of the planar surfaces to secure the ferrule with the encircled coaxial cable; and d) said step of compressing including the step of urging migration of material of the at least one ridge into the corners of the hexagon defined by the crimp tool to maintain the interior surface of the ferrule generally circular and enhance formation of a seal about the coaxial cable by the ferrule.

16. The method as set forth in claim 15 wherein said step of compressing comprises the step of compressing simultaneously a plurality of ridges encircling the ferrule.

17. The method as set forth in claim 15 including the step of sealing the space intermediate the interior of the ferrule and the jacket of the coaxial cable with a bushing.

18. The method as set forth in claim 17 wherein the connector includes a nut rotatably attached to the body for securing the connector to a piece of equipment and including the step of sealing the junction between the nut and the piece of equipment upon attachment of the nut to the piece of equipment.

19. The method as set forth in claim 18 wherein the connector includes a nut rotatably attached to the body for securing the connector to a piece of equipment and including the step of sealing the junction between the nut and the body upon attachment of the nut to the piece of equipment.

20. In a connector for terminating the terminal end of a coaxial cable by attaching the connector with a hexagonal crimp delivered by a conventional crimping tool, which connector includes a rotatably attached nut, a body for penetrably engaging the coaxial connector and a ferrule extending from the body and defining a generally circular interior for encircling and compressively engaging the coaxial cable, the improvement comprising in combination: at least one ridge encircling the ferrule proximate one end of the ferrule for crimping by the crimp tool, at least one of said ridges having a modified hexagonal perimeter defining three pairs of parallel planar surfaces and curved surfaces interconnecting adjacent ones of the planar surfaces to accommodate migration of material of said ridges upon crimping of said ridges about the coaxial cable to permit maintenance of a generally circular interior surface of the ferrule adjacent the encircled coaxial cable.

21. The improvement as set forth in claim 20 including a bushing disposed interior of and at the one end of said ferrule for sealing the junction between the coaxial cable and said ferrule.

22. The improvement as set forth in claim 21 including a depression disposed in said ferrule for receiving said bushing.

23. The improvement as set forth in claim 20 wherein said at least one ridge includes at least two ridges.

24. The improvement as set forth in claim 23 including a land disposed between said two ridges.

* * * * *

UNITED STATES PATENT AND TRADEMARK OFFICE

CERTIFICATE OF CORRECTION

PATENT NO. : 5,499,934

DATED : 3/19/96

INVENTOR(S) : Jacobsen et al.

It is certified that error appears in the above–identified patent and that said Letters Patent are hereby corrected as shown below:

Column 7

In Claim 9, line 3, delete "end", substitute --and--;

Column 8

In Claim 19, line 1, delete "18", substitute --15--.

Signed and Sealed this

Twenty-second Day of October, 1996

*Attest:*

Bruce Lehman

BRUCE LEHMAN

*Attesting Officer*

*Commissioner of Patents and Trademarks*